United States Patent [19]

Iwata et al.

[11] 4,211,952

[45] Jul. 8, 1980

[54] SPARK PLUG

[75] Inventors: Toshiharu Iwata, Aichi; Tadashi Hattori, Okazaki, both of Japan

[73] Assignee: Nippon Soken, Inc., Nishio, Japan

[21] Appl. No.: 891,126

[22] Filed: Mar. 28, 1978

[30] Foreign Application Priority Data

Apr. 7, 1977 [JP] Japan ..... 52/40127
Apr. 11, 1977 [JP] Japan ..... 52/41236

[51] Int. Cl.[2] ..... H01T 13/20
[52] U.S. Cl. ..... 313/143
[58] Field of Search ..... 313/143, 120, 118

[56] References Cited

U.S. PATENT DOCUMENTS

| | | | |
|---|---|---|---|
| 1,276,396 | 8/1918 | Mummert | 313/143 |
| 2,353,620 | 7/1944 | Weinerth | 313/143 |

FOREIGN PATENT DOCUMENTS

| | | | |
|---|---|---|---|
| 492457 | 7/1919 | France | 313/143 |
| 829344 | 6/1938 | France | 313/143 |
| 166520 | 10/1922 | United Kingdom | 313/143 |

*Primary Examiner*—Palmer C. Demeo
*Attorney, Agent, or Firm*—Cushman, Darby & Cushman

[57] ABSTRACT

A spark plug for internal combustion engines has a labyrinth groove formed in the vicinity of the open end of a space defined by the outer surface of an insulator leg, the inner surface of a metal plug body and a packing so as to restrict entry of fresh air-fuel mixture therein.

7 Claims, 8 Drawing Figures

SPARK PLUG

BACKGROUND OF THE INVENTION

The present invention relates to spark plugs for internal combustion engines, and more particularly the invention relates to an improved spark plug which is highly resistant to carbon fouling.

It has been the tendency of the previously known spark plugs to cause incomplete combustion due to the flame propagation, thus causing a carbon deposition on the surface of the insulator leg portion and thereby causing insulation failure and misfiring. This has also been confirmed from the fact that carbon fouling increases as the spark timing is advanced even if the other conditions are maintained the same.

SUMMARY OF THE INVENTION

With a view to overcoming the foregoing deficiencies, it is a main object of the present invention to provide an improved spark plug wherein a metal plug body or shell is provided with a restrictor section disposed to reduce the opening area of the open end of a space in the plug, and the restrictor section is provided with a depressed labyrinth groove formed in the portion opposing the leg portion of an insulator, whereby during the compression stroke of the engine, the velocity of a fresh mixture flowing into the space is decreased by the restrictor section with the labyrinth groove, thus retarding the entry of the fresh mixture into the space to thereby create an atmosphere in the space which tends to prevent incomplete combustion during the initial ignition and also preventing the propagation of the initial flame into the space by virtue of the decreased flow velocity of the fresh mixture.

BRIEF DESCRIPTION OF THE DRAWING

FIG. 1(*b*) is a bottom view of FIG. 1.

FIG. 3(*b*) is a bottom view of FIG. 3(*a*).

DESCRIPTION OF THE PREFERRED EMBODIMENTS

Preferred embodiments of the present invention will now be described.

Figure 1A:
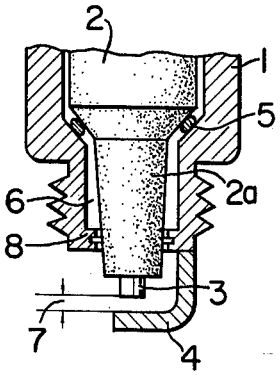
FIG. 1(*a*) is a sectional view showing the principal parts of an embodiment of a spark plug according to the invention.
Figure 1B:
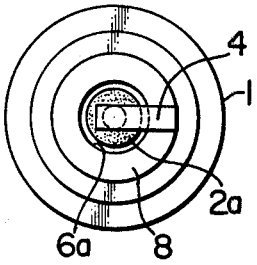
Figure 2:
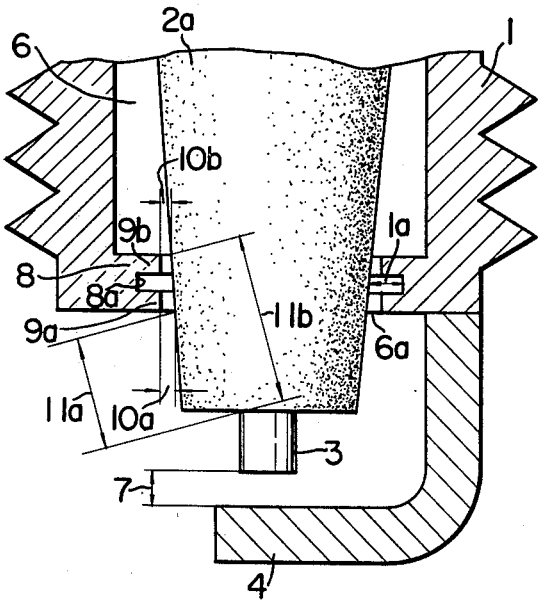
FIG. 2(*a*) is an enlarged sectional view showing a part of FIG. 1.

Referring to FIGS. 1(*a*) and 1(*b*) and FIG. 2 showing a first embodiment of the invention, an insulator 2 is fixedly mounted in place inside a metal plug body or shell 1 through the intermediary of a ring-shaped metal packing 5. A center electrode 3 is fixedly mounted in a leg portion 2*a* of the insulator 2 which is exposed into the combustion chamber (not shown) of the engine. Positioned opposite to the tip of the center electrode 3 is the end side of a ground electrode 4 fixed to the end of the plug body 1 and a spark gap 7 is provided between the electrodes. A space portion 6 defined by the leg portion 2*a* of the insulator 2, the plug body 1 and the packing 5 is opened to the combustion chamber in a direction of the spark gap 7. Formed integral with the end of the plug body 1 is an annular restrictor section 8 which reduces the opening area of an open end 6*a* of the space portion 6. A depressed labyrinth groove 8*a* is formed in the portion of the annular restrictor section 8 which is opposite to the leg portion 2*a* of the insulator 2, and first and second ridge portions 9*a* and 9*b* are formed on both sides of the labyrinth groove 8*a*. Numerals 10*a* and 10*b* designate first and second restriction gaps which are respectively defined between the first and second ridge portions 9*a* and 9*b* and the leg portion 2*a* of the insulator 2. Numerals 11*a* and 11*b* designate first and second creeping gaps extended along the surface of the leg portion 2*a* of the insulator 2 respectively to the first and second restriction gaps 10*a* and 10*b* and connected in series therewith. Assuming that the distance of the spark gap 7 defined between the center electrode 3 and the ground electrode 4 is G7 mm, and the distances of the first restriction gap 10*a*, the second restriction gap 11*b*, the first creeping gap 11*a* and the second creeping gap 10*b* are respectively G10*a* mm, G10*b* mm, G11*a* mm and G11*b* mm, the proper values are ones which satisfy the relations of the following formulas:

$$\tfrac{1}{2}\,G11a+G10a \geqq G7 \geqq G10a \qquad 1.$$

$$\tfrac{1}{2}\,G11b+G10b \geqq G7 \geqq G10b \qquad 2.$$

With the construction described above, the operation of the spark plug will now be described. The spark plug must cause sparks to jump across the spark gap 7 to ignite the mixture and thus it is undesirable to allow the spark to travel from the center electrode 3 along the first and second creeping gaps 11*a* and 11*b* and jump to the first and second ridge portions 9*a* and 9*b* of the restrictor section 8 through the first and second restriction gaps 10*a* and 10*b*. To prevent this, among (a) the spark gap 7, (b) the sum of the first creeping gap 11*a* and the first restriction gap 10*a* and (c) the sum of the second creeping gap 11*b* and the second restriction gap 10*b*, the dielectric breakdown voltage of the spark gap 7 in (a) must be minimized. Generally, in order that the same dielectric breakdown voltage may be ensured, the distance of the first and second creeping gaps 11*a* and 11*b*, respectively, must be about two times that of the spark gap 7, and consequently the relations $\frac{1}{2}$ G11*a*+G10*a*≧G7 and $\frac{1}{2}$ G11*b*+G10*b*≧G7 must be satisfied to ensure that sparks jump across the spark gap 7. On the other hand, to prevent the propagation of the initial flame into the space portion 6, it is desirable that the first and second restriction gaps 10*a* and 10*b* satisfy the relations G7≧G10*a* and G7≧G10*b*. By satisfying these relations, the combustion heat of the initial flame can be removed by virtue of the heat dissipation by the restrictor section 8 through the plug body 1 to thereby prevent the propagation of the flame into the space portion 6.

The following two conditions exist within the space portion 6, that is, (a) the condition which allows mixing with a fresh mixture of a relatively large amount of the burned gas produced by the previous cycle and (b) the combustion head tends to be dissipated by the plug body surrounding the space portion 6, and thus the propogation of a relatively low temperature initial flame into the space portion 6 will cause an incomplete combustion and hence a carbon fouling. If the deposition of carbon on the leg portion 2*a* extends to the packing 5, the current flow from the center electrode 3 will leak to the plug body 1 through the carbon deposits and the packing 5, and thus no spark will jump across the spark gap 7, thus causing misfiring. With this embodiment, however, by virture of the fact that the restrictor section 8 including the depressed labyrinth groove 8*a* is provided at the end of the plug body 1, the first restriction gap 10*a*, a gap 1*a* between the bottom portion of the labyrinth groove 8*a* and the leg portion 2*a* of the insulator 2 and the second restriction gap 10*b* exist at the open end 6*a* of the space portion 6, with the result that when a fresh mixture is introduced into the space portion 6 during the compression stroke of the engine, the mixture flows through the first restriction gap 10*a*, the gap 1*a* which is greater in size than the first restriction gap 10*a* and the second restriction gap 10*b* which is smaller in size than the first restriction gap 10*a* in such a manner that the mixture flows through the smallest second restriction gap 10*b* without causing any turbulence in the gap 1*a*, and the velocity of the fresh mixture flowing into the space portion 6 through the open end 6*a* is decreased. As a result, during the initial period of the ignition, there is practically no possibility of the initial flame propagating and develop in the direction of the space portion 6. Also, by virtue of the fact that the velocity of the fresh mixture flowing into the space portion 6 is decreased in this way, the rate of the fresh mixture flowing into the space portion 6 is decreased and an atmospher is produced within the space portion 6 which tends to prevent the occurrence of misfiring during the initial ignition. This positively prevents the propagation of the initial flame. Further, the prevention of the fresh mixture flow into the space portion 6 has the effect of reducing the pressure loss during the burning of the mixture in the combustion chamber and increasing the engine power output.

While, in the embodiment described above, the number of the labyrinth groove 8 in the restrictor section 8 is one, a plurality of such labyrinth grooves may be provided. The latter arrangement is more effective.

Further, the known multi-gap spark plugs have been used in engines of the type employing lean mixtures, engines with sub-chambers, rotary piston engines and the like which have poor ignition properties and tendency to cause carbon fouling, and the incorporation of the present invention in such multi-gap spark gaps will be extremely advantageous.

Moreover, while, in the embodiment described above, the restrictor section 8 is provided on the inner side of the end of the plug body 1, its location is not limited to the plug body end and the restrictor section 8 may be provided at a position located inwardly of the end of the plug body 1. In this case, the open end 6*a* of the space portion 6 means the open end portion near the restrictor section 8.

Still further, the restrictor section 8 need not always be annular in shape, and it may be formed with a plurality of kerfs.

Figure 3A:
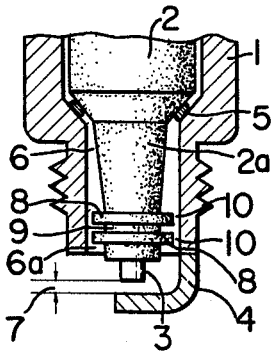
FIG. 3(*a*) is a sectional view showing the principal parts of a second embodiment of the spark plug according to the invention.
Figure 3B:
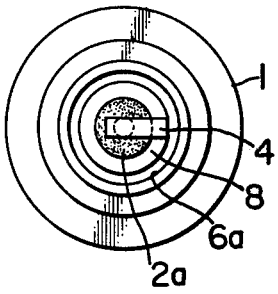

The second embodiment of the invention shown in FIGS. 3(*a*) and 3(*b*) will now be described. In the Figures, an insulator 2 is fixedly positioned inside a metal plug body 1 through the intermediary of a metal packing 5. A center electrode 3 is fixedly mounted in a leg portion 2*a* of the insulator 2 which is exposed to the inside of an engine combustion chamber, and a spark gap 7 is provided between the center electrode 3 and the forward end of a ground electrode 4 fixed to the end of the plug body 1. A space portion 6 defined by the plug body 1, the leg portion 2*a* of the insulator 2 and the packing 5 is opened in the direction of the spark gap 7 through an open end 6*a*. The leg portion 2*a* of the insulator 2 is provided, in the vicinity of the open end 6*a* of the space portion 6, with a pair of annular projections 8 formed integral therewith in a tandem relation and arranged at a suitable distance from the forward end of the leg portion 2*a* (i.e., that end from which the tip of the center electrode 3 is projected). An unprocessed straight portion 9 is provided between the annular projections 8 and between the lower annular projection 8 and the forward end of the leg portion 2*a* of the insulator 2. By thus providing the annular projections 8, restrictions 10 are discontinuously provided in the open end 6*a* of the space portion 6.

With the construction described above, the operation of the second embodiment is as follows. When a fresh mixture is introduced into the space portion 6 through the open end 6*a* during the compression stroke of the engine, by virtue of the fact that the two annular projections 8 are formed on the leg portion 2*a* of the insulator 2 thus discontinuously providing the restrictions 10 in the open end 6*a* of the space portion 6, the velocity of the fresh mixture flowing into the space portion 6 is decreased considerably by the restrictions 10 and consequently the flame during the initial ignition period is retard from propagating into the space portion 6 along with the fresh mixture flowing thereinto. Further, by virtue of the fact that the fresh mixture tends to stagnate at the straight portions 9 due to the restrictions 10, if in this condition the initial ignition takes place, the temperature rises satisfactorily at the straight portions 9 so that even if carbon is deposited on the leg portion 2*a* of the insulator 2 due to the incomplete combustion within the space portion 6, the carbon deposits will be readily burned off by virtue of the temperature of the straight portions 9 and no leakage will be caused. Moreover, since the two restrictions 10 are provided by the annular projections 8, the creeping distance on the forward end side of the leg portion 2*a* of the insulator 2 is increased, with the result that the danger of erratic ignition from the center electrode 3 to the inner side of the plug body 1 is eliminated and this also tends to prevent the propagation of the initial flame into the space portion 6.

Figure 4:
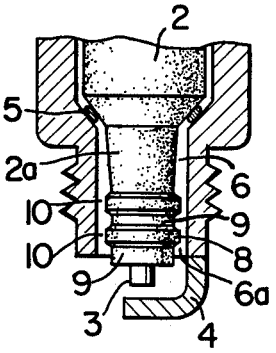
FIGS. 4 to 6 are sectional views showing the principal parts of other embodiments of the present invention.

FIG. 4 illustrates a third embodiment of the invention in which the corners of the two annular projections 8 are tapered.

Figure 5:
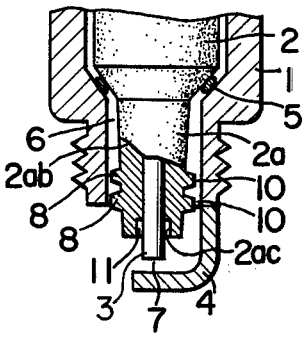

FIG. 5 illustrates a fourth embodiment of the invention in which the open end side of a hole 2*ab* formed in the leg portion 2*a* of the insulator 2 is expanded so as to provide an electrode gap 11 between the resulting expanded hole 2*ac* and the tip of the center electrode 3. In this embodiment, as compared with the previously mentioned embodiments, the creeping distance is increased by the provision of the electrode gap 11 thus preventing the occurrence of erratic ignition and moreover the heat receiving area of the leg portion 2*a* at its forward end is increased thus improving the carbon burn-off effect.

Figure 6:
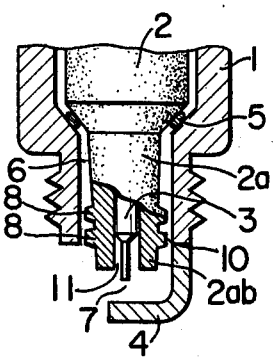

FIG. 6 illustrates a fifth embodiment of the invention in which the diameter of the center electrode 3 is decreased at its forward end as compared with the other component parts and thus an electrode gap 11 is provided between the hole 2*ab* of the leg portion 2*a* and the tip of the center electrode 3, and the functions and effects of this embodiment are the same as the embodiment of FIG. 5.

While, with the embodiments described above, when the combustion stroke proceeds from the initial combustion stage so that the burning of the mixture within the combustion chamber becomes more vigorous and the pressure increases thus allowing the flame to propagate into the space portion 6, in this case the flame temperature is so high that there is no danger of carbon fouling.

Further, the known multi-gap spark plugs are currently in use with the engines of the type employing lean mixtures, engines with sub-chambers, rotary piston engines and the like which have poor ignition properties and tendency to cause carbon fouling, in preference to the conventional spark plugs of the ordinary type, and consequently the present invention may be exceedingly advantageously incorporated in such multi-gap spark plugs.

Still further, the present invention is not intended to be limited to the spark plugs of the type in which the forward end of the leg portion 2*a* of the insulator 2 is projected beyond the end of the plug body 1 as in the case of the previously mentioned embodiments, and the invention may be incorporated in spark plugs of the type in which the forward end of the leg portion 2*a* is positioned inwardly of the end of the plug body 1.

Still further, the member of the annular projections 8 may be three or four, and at least two such annular projections are required to ensure the advantages of the present invention.

We claim:

1. In a spark plug having a metal plug body, an insulator fixedly positioned inside said plug body through the intermediary of a packing, a center electrode fixedly mounted in a leg portion of said insulator and disposed for exposure to the inside of an engine combustion chamber, and a ground electrode fixed to one end of said plug body and having one end thereof positioned opposite to said center electrode whereby a spark gap is provided between said ground electrode and said center electrode, the improvement wherein:

a space opening at one end thereof to said combustion chamber is defined by said plug body, said packing and said leg portion of said insulator, and restricting means having an annular groove is provided to form a plurality of restriction gaps between said plug body and said leg portion in the vicinity of the open end of said space to restrict entry of air-fuel mixture, said restriction gaps each being smaller than said spark gap.

2. A spark plug according to claim 1, wherein said restricting means comprises a restricting gap section formed integral with said plug body extending radially and inwardly to reduce the opening area of said open end of said space, and wherein a depressed labyrinth groove is provided in a portion of said restricting gap section disposed opposite to said leg portion of said insulator.

3. A spark plug according to claim 1, wherein said restricting means comprises at least two annular projections formed on the leg portion of said insulator in the vicinity of the open end of said space, said projections being arranged in tandem at a distance from the forward end of said leg portion, and wherein a pair of restrictions are provided discontinuously in the open end of said space by said annular projections.

4. A spark plug according to claim 3, wherein:

said insulator leg portion has means defining a forwardly opening longitudinal bore therein having an opening at a forward end thereof, the center electrode being received in said bore and having a forward end extending forwardly out of said forward end opening; said longitudinal bore closely fitting said center electrode distally of said forward end opening, but being relatively enlarged adjacent said forward end opening whereby an electrode gap is provided radially between the center electrode and the longitudinal bore adjacent said forward end of said center electrode.

5. A spark plug according to claim 3, wherein:

said insulator leg portion has means defining a forwardly opening longitudinal bore therein having an opening at a forward end thereof, the center electrode being received in said bore and having a forward end extending forwardly out of said forward end opening; said longitudinal bore closely fitting said center electrode distally of said forward end opening; said center electrode adjacent said forward end thereof being relatively reduced in diameter compared with said longitudinal bore whereby an electrode gap is provided radially between the center electrode and the longitudinal bore adjacent said forward end of said center electrode.

6. In a spark plug having a metal plug body, an insulator fixedly positioned inside said metal plug body through the intermediary of a ring of packing, this insulator having a leg portion which extends from within said metal plug body to outside said metal plug body through means defining an opening into said metal plug body, a center electrode fixedly mounted in said leg portion and disposed for exposure to the inside of an engine combustion chamber, and a ground electrode fixed to one end of the metal plug body and having one end thereof positioned opposite to the center electrode thereby providing a spark gap between the ground electrode and the center electrode, the improvement, comprising:

a space is defined within said spark plug radially between the metal plug body and the leg portion of the insulator, said space being closed within the spark plug by said ring of packing;

a perimetrically extending restrictor flange means provided on one of said insulator leg portion and said metal plug body and extending radially toward the other of said metal plug body and said insulator leg portion so that said opening extends between said restrictor flange means and said metal plug body and so that said space opens exteriorly of the spark plug through said opening;

means defining a perimetrically extending, radially opening groove in said restrictor flange means intermediate the axial extent of said restrictor flange means thereby defining a perimetrically extending axially outer ridge and a perimetrically extending axially inner ridge respectively axially bordering said groove;

said axially outer ridge and said insulator leg portion thereby defining a first perimetrically extending restriction gap radially between them, and said axially inner ridge and said insulator leg portion thereby defining a second perimetrically extending restriction gap radially between them;

each of said restriction gaps being smaller than said spark gap.

7. The improved spark plug of claim 6, further comprising:

surface means defining a first creeping gap longitudinally, superficially exteriorly on said insulator leg portion from said center electrode to an imaginary radial projection of the axially outer extent of axially outer ridge upon said insulator leg portion;

surface means defining a second creeping gap longitudinally, superficially exteriorly on said insulator leg portion from said center electrode to an imaginary radial projection of the axially inner extent of said axially inner ridge upon said insulator leg portion;

one-half the magnitude of said first creeping gap plus the magnitude of said first restriction gap being no smaller than equal to the magnitude of said spark gap, which is no smaller than equal to the magnitude of said first restriction gap; and one-half the magnitude of said second creeping gap plus the magnitude of said second restriction gap being no smaller than equal to the magnitude of said spark gap, which is no smaller than equal to the magnitude of said second restriction gap.

* * * * *